US006460495B1

(12) United States Patent
Seitz et al.

(10) Patent No.: US 6,460,495 B1
(45) Date of Patent: Oct. 8, 2002

(54) SWITCHABLE SUPPORT ELEMENT

(75) Inventors: Joachim Seitz, Reundorf; Dieter Schmidt, Nürnberg; Michael Haas; Bodo Rörig, both of Weisendorf, all of (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 10/008,915

(22) Filed: Dec. 3, 2001

(30) Foreign Application Priority Data

Dec. 11, 2000 (DE) ..... 100 61 594

(51) Int. Cl.[7] ..... F01L 1/12

(52) U.S. Cl. ..... 123/90.16; 123/90.41; 123/90.65; 123/198 F

(58) Field of Search ..... 123/90.16, 90.39, 123/90.41, 90.43, 90.65, 198 F

(56) References Cited

U.S. PATENT DOCUMENTS

| | | | | |
|---|---|---|---|---|
| 1,302,556 A | | 5/1919 | Huber | |
| 1,368,439 A | | 2/1921 | Kemble | |
| 3,280,806 A | | 10/1966 | Iskenderian | |
| 4,481,919 A | | 11/1984 | Honda et al. | |
| 4,546,734 A | * | 10/1985 | Kodama | 123/90.16 |
| 5,720,244 A | * | 2/1998 | Faria | 123/90.16 |
| 5,875,748 A | * | 3/1999 | Haas et al. | 123/90.16 |
| 6,314,927 B1 | * | 11/2001 | Schnell | 123/90.16 |
| 6,321,704 B1 | * | 11/2001 | Church et al. | 123/90.16 |

FOREIGN PATENT DOCUMENTS

| | | |
|---|---|---|
| DE | 354659 | 6/1922 |
| DE | 703801 | 3/1941 |
| DE | 19914046 | 9/2000 |
| GB | 2134977 | 8/1984 |

* cited by examiner

*Primary Examiner*—Weilun Lo
(74) *Attorney, Agent, or Firm*—Bierman, Muserlian and Lucas

(57) ABSTRACT

In a switchable support element (1) for a valve train of an internal combustion engine, the lost motion spring (8) of the valve train is made as a torsion spring. This spring is arranged outside of the support element (1) and only the legs and the arms of the spring engage a housing and a head, respectively. In this way, the support element (1) requires no substantially larger design space than non-switchable prior art elements, particularly in axial direction.

21 Claims, 2 Drawing Sheets

SWITCHABLE SUPPORT ELEMENT

FIELD OF THE INVENTION

The invention concerns a switchable support element for a finger lever of a valve train of an internal combustion engine, said support element comprising a housing, an inner element, a coupling means and at least one spring, the housing being telescoped with the e inner element which is biased away from m the housing by the spring and extends beyond an end of the housing by a head that comprises a support for the finger lever, the coupling means being configured for selectively coupling the housing to the inner element in an axially extended state of the housing and the inner element.

BACKGROUND OF THE INVENTION

A generic support element of the pre-cited type is disclosed in DE 44 22 340 A1. This support element has the inherent drawback of a relatively large overall height. As a person skilled in the art will see from the figure, due to the compression spring being arranged under the inner element, a considerably large design space is required. If such a support element is to be integrated, for example, into existing engine designs, its relatively large height can lead to design space problems. Also, it is often not possible to deepen the reception bore for the support element in the cylinder head because one would penetrate into the region of inlet, outlet and cooling channels or the like.

Other known switchable support elements have a relatively large overall width due to their special concentric spring arrangement, or due to other design features.

OBJECTS OF THE INVENTION

It is an object of the invention to provide a support element of the pre-cited type in which the aforesaid drawbacks are eliminated.

This and other objects and advantages of the invention will become obvious from the following detailed description.

SUMMARY OF THE INVENTION

The invention achieves the above objects by the fact that the spring is arranged substantially or entirely axially outside of the housing while being supported with one end in a region of the end of the housing and with a further end, on the head of the inner element in a vicinity of the support of the head.

This inventive concept also includes a solution in which a coil spring, known per se, surrounds the inner element concentrically outside of the housing. Preferably, however, it is intended to use torsion springs or clips which, according to a preferred embodiment of the invention extend at a radial distance from the support element. These torsion springs, also called leg springs, are positioned with their coils outside of the cylinder head so that other components such as walls, spark plugs, camshaft bearings etc., situated in this region are not affected.

Taken as a whole, the invention proposes a switchable support element that requires only a small design space and can thus be integrated in most cases into existing engine designs. Engine manufacturers therefore do not need to make complicated modifications to the overall design of the engines. Distances once defined, for instance the distance of the camshaft axis from the crankshaft axis and others, can be retained. In particular, due to the sideward shifting of the spring element, the proposed support element is relatively flat compared to prior art support elements, for example, compared to the support element disclosed in DE 197 10578 A1.

It is conceivable to use a variety of other spring elements such as leaf springs, flat coil springs, torque rods and the like.

The spring, which is also designated as a lost motion spring, possesses, despite its relatively compact dimensions, such a good spring rate that a reliable re-setting and retention of the inner element during contact of the finger lever with the run-off profile of the cam can be expected over the entire speed range of the internal combustion engine in which the lost motion function of the spring is required (speeds of, for example, up to about 2500 r.p.m.).

Other features of the invention concern advantageous configurations of the ends of the spring which is preferably made as a torsion spring. It goes without saying that in place of a single torsion spring as the spring means, a plurality of inter-inserted or adjoining springs may also be used.

According to one proposition of the invention, legs of the spring which emerge from front ends of the spring from the coils may have end extensions through which a fixing on the housing can be effected. In place of the extensions, the spring of the invention may also comprise loops or the like which can be mounted on pins on the end of the housing. As an alternative, it is proposed to have the legs surround the housing in the manner of a ring and support them in the direction toward the housing on an annular shoulder thereof.

The further end of the spring may be configured as a pair of arms that emerge centrally from the coils and extend toward the support element to again surround the support element in the region of the head of the inner element in the manner of a ring. A simply realizable fixing measure for these arms in the direction away from the housing is to support them on a separate securing element such as a circlip or on an annular shoulder of the inner element.

Alternatively, it is proposed that the legs of the one end of the spring emerge centrally from the coils and be supported on the end of the housing while the arms of the further end of the spring surround the inner element in the region of the head in the manner of a ring. A simple support surface for the arms in the direction toward the finger lever can be realized in this case in that they bear against a securing element like the aforesaid circlip or the like.

In order not to unnecessarily obstruct the sink-in movement of the inner element during the idling stroke of the inner element into the housing in the uncoupled state of the support element, it is proposed that the arms that surround the inner element in the manner of a ring comprise two inward bends that are in contact only with the inner element. Since, during this sink-in movement, the arm is bent towards the housing against the spring force of the spring, no important obstruction is created at the point of contact of the arm with the inner element.

Further, it must be remarked that the inventive configuration and arrangement of the spring offers a great amount of freedom in the designing and construction of the contacting finger lever that may be made, for example, as a thin-walled sheet metal finger lever. Thus, if required, the lower region of the finger lever that faces the support element may advantageously be configured with a larger thickness which would enhance its rigidity.

It is clear that the scope of protection of the invention extends to a great number of variations of the claimed configuration of the spring with its legs and arms. Further, in place of the torsion spring, it is also possible to use a clip or a clasp with its finger ends engaging the support element.

The invention will now be described with reference to the appended drawings.

DETAILED DESCRIPTION OF THE DRAWINGS

Figure 1:
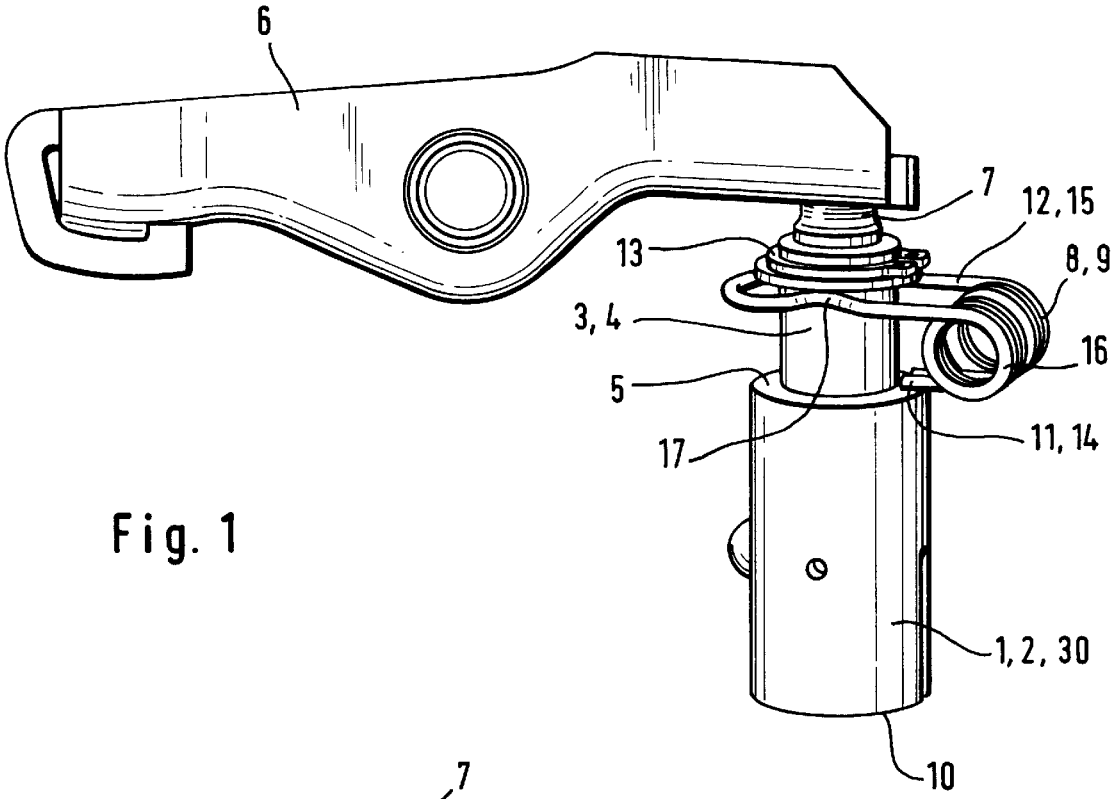
FIG. 1 is a view of a support element of the invention in contact with a finger lever.

FIG. 1 discloses a switchable support element 1 comprising a housing 2 that is telescoped with an inner element 3. The inner element 3 extends with its head 4 beyond an end 5 of the housing 2 towards a finger lever 6. On its end, the head 4 of the inner element 3 comprises a support 7 on which one end of the finger lever 6 is supported. The other end of the finger lever 6 acts on a gas exchange valve, not shown in the drawing.

Arranged within the support element 1 is a coupling means, not shown, through which the inner element 3 and the housing 2 can be selectively coupled to each other in their axially extended state.

To assure a return of the inner element 3 toward the finger lever in the uncoupled state of the support element 1 (see also discussion of advantages), the inner element 3 is biased in a direction away from the housing 2 by a spring 8 that is described more closely below.

According to the invention, this spring 8 is arranged axially substantially outside of the housing 2. The spring 8 is made as a torsion spring with coils 9 whose longitudinal axis is offset at 90° to the longitudinal axis of the support element 1. The figures disclose that the coils 9 are arranged radially outside of the support element 1. When the support element 1 is installed in a reception of the cylinder head, not shown, the spring 8 would thus extend above the cylinder head radially outside of the reception.

Due to the outwards shifted position of the spring 8 and its configuration described more closely below, the switchable support element 1 of the invention corresponds in dimension approximately to prior art support elements. Thus, the aforesaid reception for the housing 2 in the cylinder head does not have to be significantly larger in axial nor in radial direction than prior art receptions. It is to be noted in this connection that the prior art spring extends directly within the housing i.e., axially below the inner element and above a bottom (here, bottom 10) of the housing and is configured as a coil spring. This measure unnecessarily increases the overall length, or in other configurations, the diameter of the support element.

FIG. 1 shows a spring 8 which, as already mentioned, is made as a torsion spring. This spring 8 is placed with one end 11 on the end 5 of the housing 2. A further end 12 of the spring 8 acts against a securing element 13 in the region of the head 4 of the inner element 3. The securing element 13 is configured in this case as a circlip. The one end 11 is made up of two legs 14 that extend centrally from the coils 9 onto the end 5 of the housing 2. The further end 12 comprises two arms 15 which extend from front ends 16 of the coils 9 and surround the head 4 in the manner of a clip. The arms 15 are configured so as to be laterally spaced from the head 4. Contact with the head 4 is established solely through two opposite inward bends 17. This measure facilitates the sink-in movement of the inner element 3 during its displacement relative to the housing 2 in the switched-off mode of the support element 1.

Figure 2:
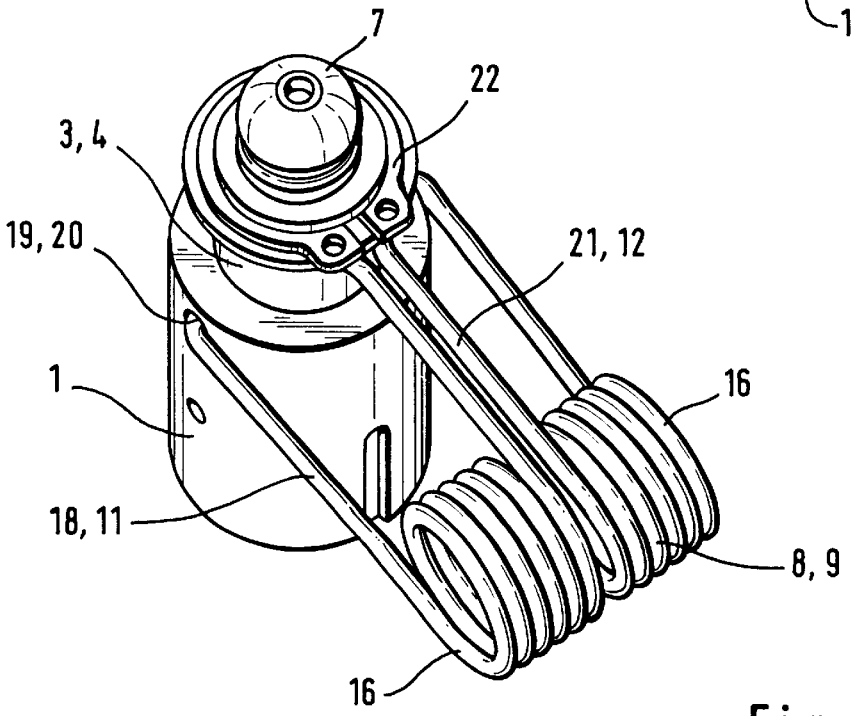
FIG. 2 shows one embodiment of the spring of the invention.

According to FIG. 2, the one end 11 of the spring 8 comprises opposing legs 18 that extend from the front ends 16 of the coils 9. These legs 18 surround the housing 2 in the manner of a clip in the region of its end 5 and possess end extensions 19. Through these extensions 19, the legs 18 are snapped into recesses 20 of the housing 2.

The further end 12 of the spring 8 extends centrally from its coils 9 and comprises two arms 21 that extend next to each other toward the head 4. These arms 21 surround the head 4 in the manner of a ring and act in the direction of the support 7 against a securing element 22 such as a circlip that is firmly connected to the head 4.

Figure 3:
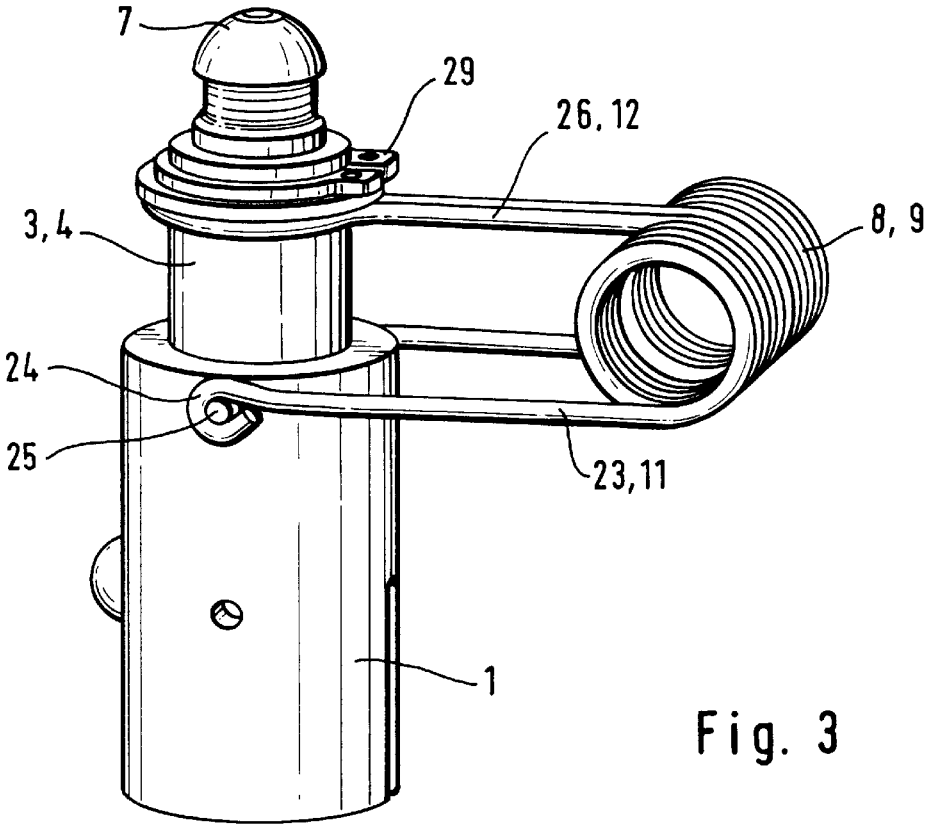
FIG. 3 shows another embodiment of the spring of the invention.

FIG. 3 discloses a spring 8 whose one end 11, similar to the embodiment of FIG. 2, is made up of two legs 23. These legs 23 possess end loops 24 that are retained on corresponding pins 25 that extend radially outwards from the housing 2. An arm 26 of the further end 12 is configured similar to the arm 21 of FIG. 2.

Figure 4:
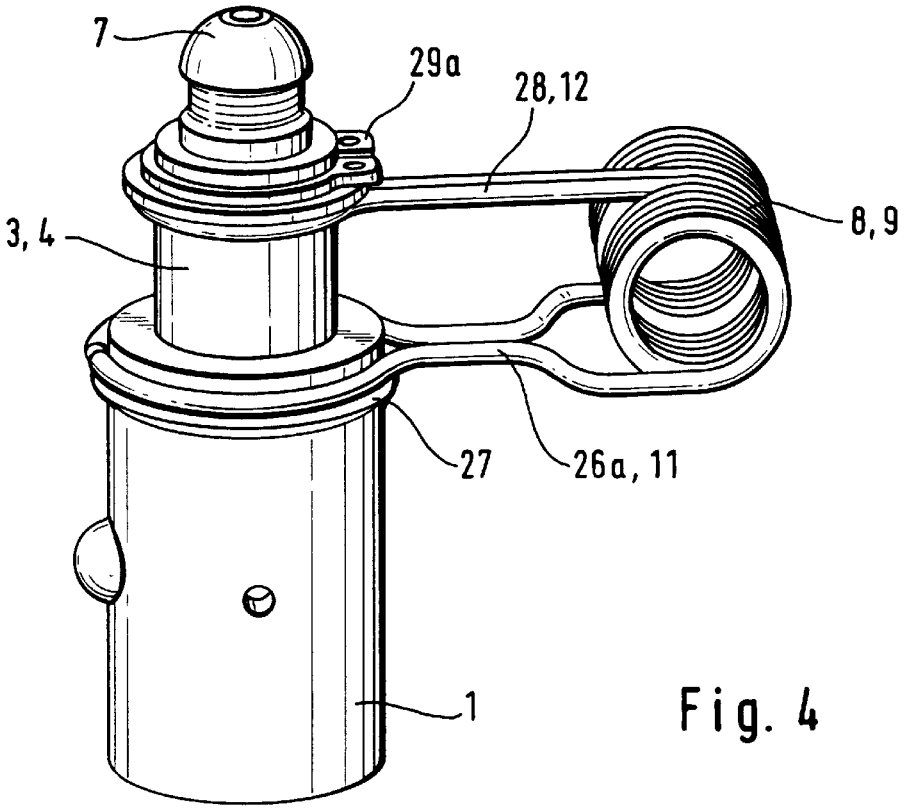
FIG. 4 shows still another embodiment of the spring of the invention.

Finally, FIG. 4 discloses a configuration similar to that of FIG. 3 with the only difference that legs 26*a* of the one end 11 of the spring 8 surround the housing 2 in the region of its end 5 in the manner of a ring and act in the direction of the housing against an annular shoulder 27 of the housing 2.

What is claimed is:

1. A switchable support element for a finger lever of a valve train of an internal combustion engine, said support element comprising a housing, an inner element, a coupling means and at least one spring, the housing being telescoped with the inner element which is biased away from the housing by the spring and extends beyond an end the housing by a head that comprises a support for the finger lever, the coupling means being configured for selectively coupling the housing to the inner element in an axially extended state of the housing and the inner element, wherein the spring is arranged substantially or entirely axially outside of the housing while being supported with one end in a region of the end of the housing and with a further end, on the head of the inner element in a vicinity of the support of the head.

2. A support element of claim 1, wherein with exception of the one end and the further end, the spring extends radially outside of the support element.

3. A support element of claim 1, wherein the spring is made as a torsion spring.

4. A support element of claim 3, wherein a longitudinal axis of coils of the spring is offset at 900 to a longitudinal axis of the support element.

5. A support element of claim 3, wherein the one end of the spring comprises two legs each of which extends from a front end of the coils of the spring, and the further end emerges approximately centrally from the coils and is formed by two adjoining arms.

6. A support element of claim 5, wherein the legs oppose each other in a clip-like manner and are fixed on a region of an outer peripheral surface of the housing near the end of the housing.

7. A support element of claim 6, wherein the legs comprise a radially inward bent end extension that engages into a recess on the outer peripheral surface of the housing.

8. A support element of claim 6, wherein the legs comprise a n end loop through which the legs are fixed on a pin projecting from the outer peripheral surface of the housing.

9. A support element of claim 6, wherein the legs are placed in a manner of a ring around the outer peripheral surface of the housing and are supported in axial direction of the housing on an annular shoulder of the outer peripheral surface of the housing.

10. A support element of claim 6, wherein the legs are placed in a manner of a ring around the outer peripheral surface of the housing and extend in an annular groove in the outer peripheral surface of the housing.

11. A support element of claim 5, wherein the two arms extend in a manner of a ring around the head of the inner element, and in a direction toward the support of the head, the arms act against an annular shoulder of the head.

12. A support element of claim 5, wherein the two arms extend in a manner of a ring around the head of the inner element, and in a direction toward the support of the head, the arms act against a separate securing element.

13. A support element of claim 12, wherein the securing element is a circlip.

14. A support element of claim 3, wherein the one end of the spring emerges approximately centrally from coils of the spring and is formed by two adjoining legs, the further end of the spring comprising two arms, each of which arms extends from a front end of the coils.

15. A support element of claim 14, wherein the arms are supported on the end of the housing.

16. A support element of claim 14, wherein the arms extend in a manner of a ring around the head of the inner element and act in axial direction of the support of the head against an annular shoulder of the head.

17. A support element of claim 14, wherein the arms extend in a manner of a ring around the head of the inner element and act in axial direction of the support of the head against a separate securing element.

18. A support element of claim 17, wherein the securing element is a circlip.

19. A support element of claim 16, wherein the arms are laterally spaced from the head and are in contact with the head only by two opposing inward bends.

20. A support element of claim 1, wherein the spring is a clip.

21. A support element of claim 1, wherein the spring is a clasp.

* * * * *